US007600895B2

(12) United States Patent
Hawkins et al.

(10) Patent No.: US 7,600,895 B2
(45) Date of Patent: Oct. 13, 2009

(54) LIGHT DISPLAY UNIT WITH FIXTURE AND LIGHT STRAND

(75) Inventors: Laura L. Hawkins, Minneapolis, MN (US); Donna L. Lein, Centerville, MN (US)

(73) Assignee: Target Brands, Inc., Minneapolis, MN (US)

( * ) Notice: Subject to any disclaimer, the term of this patent is extended or adjusted under 35 U.S.C. 154(b) by 264 days.

(21) Appl. No.: 11/503,389

(22) Filed: Aug. 11, 2006

(65) Prior Publication Data

US 2008/0037244 A1 Feb. 14, 2008

(51) Int. Cl.
*F21S 4/00* (2006.01)

(52) U.S. Cl. ..... 362/249.01; 362/125; 362/217.01; 362/225; 362/217.09; 362/576; 40/463; 40/464; 40/546; 40/559; 40/607.02

(58) Field of Classification Search ..... 362/125, 362/219, 225, 249, 555, 576, 644, 653, 654, 362/800, 806, 152, 217, 224, 432, 433, 437, 362/581, 249.01, 249.02, 249.06, 249.13, 362/249.14, 249.15, 249.16, 217.01, 217.02, 362/217.04, 217.05, 217.06, 217.07, 217.11, 362/217.12, 217.13, 217.14, 217.15, 217.16; 40/546, 463, 464, 559, 553, 607.02
See application file for complete search history.

(56) References Cited

U.S. PATENT DOCUMENTS

| | | | | |
|---|---|---|---|---|
| D188,412 | S | 7/1960 | Dempsey | |
| 3,504,172 | A | 3/1970 | Liberman | |
| 3,539,801 | A | 11/1970 | Bobrick | |
| D220,580 | S | 4/1971 | Edenberg | |
| 3,737,646 | A | 6/1973 | Burrows | |
| D234,621 | S | 3/1975 | Muller | |
| 4,259,709 | A | 3/1981 | Eddings | |
| 4,577,264 | A | 3/1986 | Plumly | |
| 4,775,921 | A | 10/1988 | Foley | |
| 4,843,527 | A * | 6/1989 | Britt | 362/231 |
| 5,142,460 | A | 8/1992 | McAtee | |
| 5,213,409 | A | 5/1993 | Fisher | |
| 5,513,081 | A | 4/1996 | Byers | |

(Continued)

OTHER PUBLICATIONS

Photographs A and B of a Christmas light fixture on display at least as early as Sep. 18, 2005 (2 pgs.).

*Primary Examiner*—Sharon E Payne
*Assistant Examiner*—Mary Zettl
(74) *Attorney, Agent, or Firm*—Griffiths & Seaton PLLC

(57) ABSTRACT

A light display unit includes a display fixture and a light strand. The display fixture includes an elongated support and a plurality of receptacles coupled to the support. The support defines a chamber. Each of the receptacles defines an aperture. The light strand includes an electrical cord having an end configured to be coupled with an electrical power source. Each of a plurality of bulb groupings is in electrical communication with the electrical cord. The plurality of bulb groupings comprises at least two different combinations of light bulbs. The electrical cord is at least partially housed in the chamber of the support and extends into each of the plurality of receptacle of the display fixture through the apertures of the receptacles such that each of the plurality of bulb groupings is positioned within one of the plurality of receptacles of the support. Light strands, fixtures, and methods provide additional advantages.

18 Claims, 10 Drawing Sheets

U.S. PATENT DOCUMENTS

| | | | | |
|---|---|---|---|---|
| 6,070,991 | A | 6/2000 | Rumpel | |
| 6,072,171 | A | 6/2000 | Nakamura | |
| 6,199,705 | B1 * | 3/2001 | Portner | 211/26 |
| 6,208,073 | B1 * | 3/2001 | Wang et al. | 313/500 |
| D441,884 | S | 5/2001 | Moriyama et al. | |
| 6,318,886 | B1 | 11/2001 | Stopa et al. | |
| 6,371,637 | B1 | 4/2002 | Atchinson et al. | |
| 6,682,205 | B2 * | 1/2004 | Lin | 362/249 |
| 6,832,842 | B2 | 12/2004 | Sullivan | |
| D513,082 | S | 12/2005 | Hoshikawa et al. | |
| 6,981,343 | B2 * | 1/2006 | Rawlings et al. | 40/638 |
| 7,128,445 | B1 * | 10/2006 | Karkay | 362/343 |
| D537,186 | S | 2/2007 | Weddell | |
| 7,243,796 | B2 * | 7/2007 | Grablick | 206/460 |
| 2005/0122722 | A1 * | 6/2005 | Menke | 362/286 |
| 2005/0141237 | A1 | 6/2005 | Goto | |
| 2006/0070279 | A1 * | 4/2006 | Whittier et al. | 40/564 |

* cited by examiner

LIGHT DISPLAY UNIT WITH FIXTURE AND LIGHT STRAND

BACKGROUND OF THE INVENTION

Strands of light bulbs (referred to herein as "light strands") have been used for decades to decorate for holidays such as Christmas. Typically, light strands are used to decorate conventional Christmas items including Christmas trees and wreaths. In more recent years, light strands are increasingly being used in less conventional manners to decorate for any number of special or everyday occasions in both interior and exterior locations. Consequently, the once limited selection of light strands has evolved to an increasingly large selection of light strands each having a different combination of bulb types, bulb spacings, bulb colors, bulb groupings, etc. Each year new bulb types are developed to further increase and diversify the available light strands.

As the number and type of light strands continues to increase, retail stores selling the light strands are encouraged to carry a larger selection of the light strands. In addition, consumers hoping to create personalized displays with the light strands often desire to view the color, effect, intensity, etc. provided by particular bulb in a light strand prior to selecting a light strand for purchase. However, the long length of typical light strands, the tendency of light strands to become easily entangled, and the large number of light strand types available complicate the display of such strands in the retail setting.

SUMMARY OF THE INVENTION

One aspect of the present invention relates to a light display unit including a display fixture and a light strand. The display fixture includes an elongated support and a plurality of receptacles coupled to the support. The support defines a chamber. Each of the receptacles defines an aperture in communication with the chamber of the support. The light strand includes an electrical cord and a plurality of bulb groupings. The electrical cord includes a first end configured to be coupled with an electrical power source. Each of the plurality of bulb groupings is in electrical communication with the electrical cord. The plurality of bulb groupings comprises at least two different combinations of light bulbs. The electrical cord is at least partially housed in the chamber of the support and extends into each of the plurality of receptacles of the display fixture through the apertures of the receptacles such that each of the plurality of bulb groupings is positioned within one of the plurality of receptacles of the display fixture. Other related products and methods are also disclosed and provide additional advantages.

BRIEF DESCRIPTION OF THE DRAWINGS

Embodiments of the invention will be described with respect to the Figures, in which like reference numerals designate like elements, and in which.

DETAILED DESCRIPTION

A light display unit is provided for use in a retail setting to display a plurality of lighted bulbs available in different light strands to potential consumers. In particular, the light display unit provides an orderly manner of presenting lighted bulbs in clusters (referred to herein as alternately as "light bulb clusters" or "bulb clusters"), each bulb cluster representing a light strand available for purchase (referred to herein as a "for-sale light strand"). In one embodiment, the bulb clusters are positioned within respective cups configured to at least partially shield the bulb cluster therein from ambient light and the light of adjacent bulb clusters to more accurately demonstrate how the bulbs of particular for-sale light strands will appear during use.

In one example, one or more of the bulb clusters includes individual light bulbs of more than one color, more than one shape, and/or more than one type of faceting. In one embodiment, where the display unit is used in a retail setting each bulb cluster includes a combination of colors, shapes, and/or facets that is the same as a combination of colors, shapes, and/or facets as a for-sale light strand, such as a boxed for-sale light strand proximately positioned to the bulb cluster. As such, the display unit is suitable for use in a retail environment to provide an attractive display that not only informs a user of available for-sale light strands, but also attracts consumers to the display and encourages purchase of corresponding for-sale light strands.

In one embodiment, although each bulb cluster is different than the other bulb clusters displayed in a single light display unit, all of the bulb clusters extend from a single electrical cord. As such, the number of cords included in the display unit is greatly reduced from conventional display units. As a result, the complications and aggravation typically caused by arranging a plurality of light strands in a single fixture are also reduced. In addition, the light display units according to the embodiment described herein provide an attractive and space efficient manner of displaying the light bulbs of a plurality of for-sale light strands. As such, a potential consumer is able to clearly view a representation of the bulbs of available for-sale light strands to evaluate the color, faceting, shape, and overall effect of the for-sale light strand. Consequently, a potential consumer is able to make a more informed decision regarding which for-sale light strand to purchase.

Figure 1:
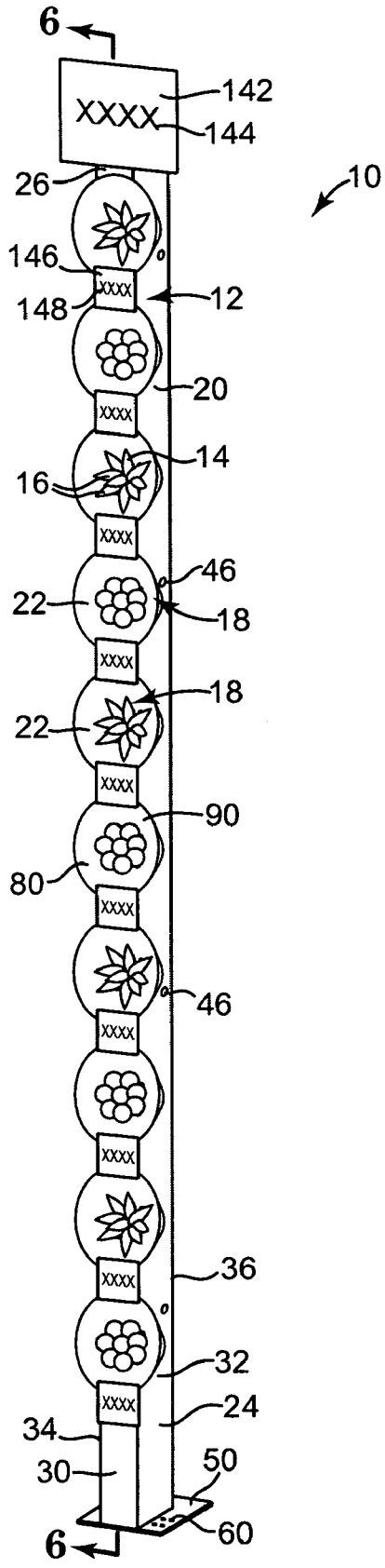
FIG. 1 is perspective view illustrating one embodiment of a light display unit, according to the present invention.

Turning to the Figures, FIG. 1 illustrates one embodiment of a light display unit 10 including a fixture 12 and a display light strand or light string 14 for use in a retail setting. The display light strand 14 generally includes a plurality of light bulbs 16 arranged in bulb clusters or bulb groupings 18. Fixture 12 is specifically configured to support and maintain each bulb cluster 18 spaced from and at least partially optically separated from adjacent bulb clusters 18. Accordingly, a single fixture 12 displays a plurality of bulb clusters 18 for viewing by a potential consumer. As such, fixture 12 is one example of means for maintaining the plurality of bulb clusters. In one embodiment, where each bulb cluster 18 includes a different bulb type and variety representative of a particular for-sale light strand (generally indicated as a box housing a for-sale light strand 150 in FIG. 8) available for purchase, a single light display unit 10 visually exhibits the working bulbs 16 of a plurality of different for-sale light strands 150 in a generally space efficient and aesthetically pleasing manner.

Figure 2:
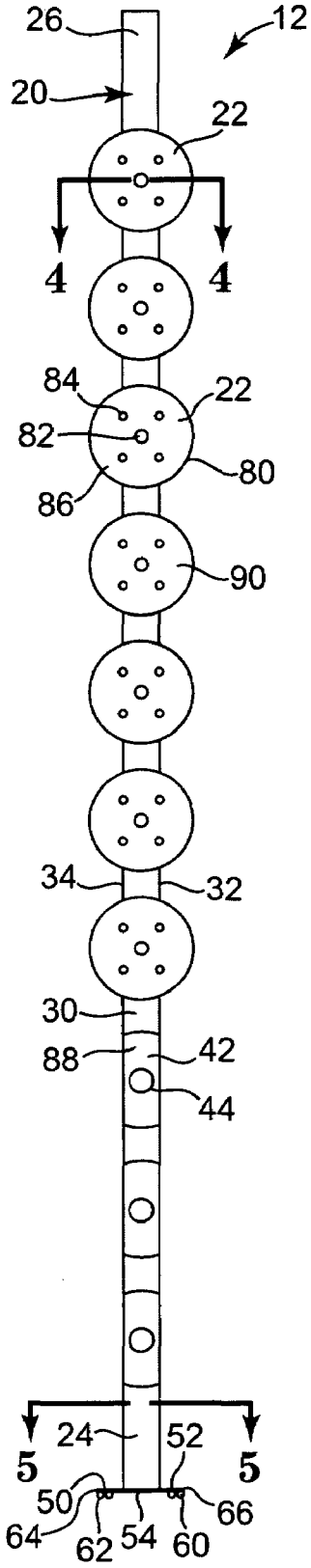
FIG. 2 is a front view illustrating one embodiment of a display fixture included in the light display unit of FIG. 1, according to the present invention.
Figure 3:
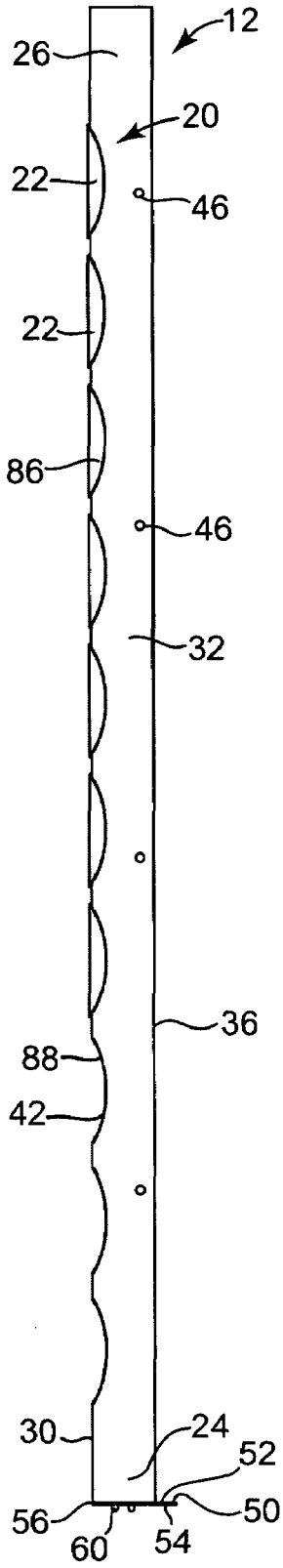
FIG. 3 is a side view illustration of the display fixture of FIG. 2.
Figure 4:
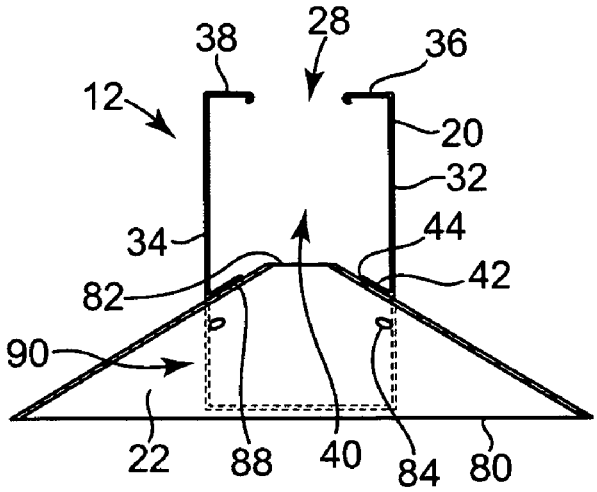
FIG. 4 is a cross-sectional view illustrating the display fixture of FIG. 2 taken along the line 4-4 in FIG. 2.
Figure 5:
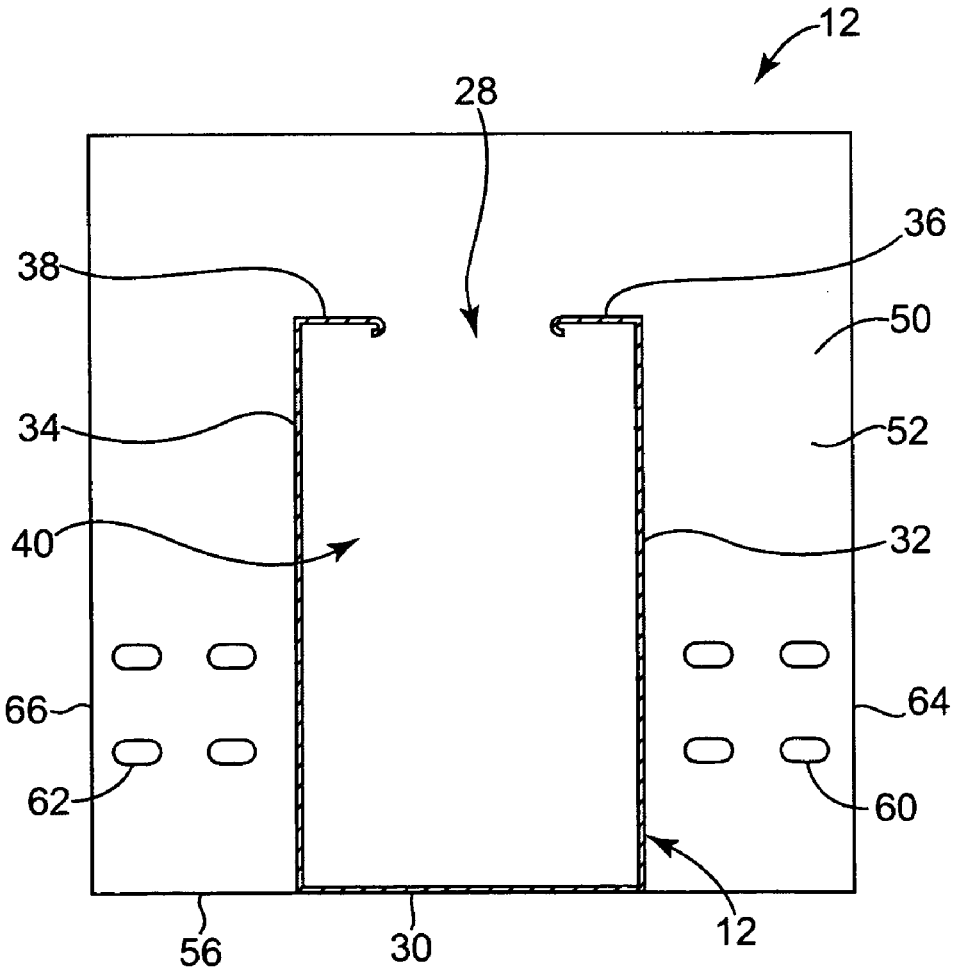
FIG. 5 is a cross-sectional view illustrating the display fixture of FIG. 2 taken along the line 5-5 in FIG. 2.

In one example, fixture 12 generally includes a support 20 and a plurality of cups or receptacles 22 coupled thereto. Support 20 may be formed in any one of a plurality of configurations and is generally configured to form the primary portion of fixture 12. In one example, as illustrated in FIGS. 1-3, support 20 is generally elongated and substantially linear. In this manner, support 20 defines a first end 24 and a second end 26 opposite first end 24. As illustrated in FIGS. 4 and 5, in one embodiment, the cross-sectional shape of support 20 is generally rectangular with an access slot 28 extending through a rear (collectively defined by rear wall portions 36 and 38 as will be further described below) thereof. In one example, access slot 28 is elongated and longitudinally extends at least along a majority of the length of the support 20 between first end 24 and second end 26.

More specifically, in one embodiment, support 20 defines a front wall 30, a first side wall 32, and a second side wall 34. Front wall 30 is rectangular and generally, although not necessarily continuously, extends along an entire length of the support 20. Each side wall 32 and 34 extends rearwardly from a longitudinal edge of front wall 30 opposite one another with an orientation substantially perpendicular to front wall 30. A first rear wall portion 36 extends from first side wall 32 opposite front wall 30 toward the second side wall 34. A second rear wall portion 38 extends from second side wall 34 opposite front wall 30 toward the first side wall 32.

In one embodiment, rear wall portions 36 and 38 are spaced similar distances from front wall 30 and extend in a direction substantially perpendicular to respective side walls 32 and 34. In one example, each rear wall portion 36 and 38 terminates before intersecting the other rear wall portion 36 or 38 to define access slot 28 between rear wall portions 36 and 38. In this manner, support 20 may be described as having a substantially U-shaped transverse cross-section. The substantially enclosed nature of support 20 defines an internal cavity 40 between the walls 30, 32, and 34, and wall portions 36 and 38. In one embodiment, rear wall portions 36 and 38 each terminate with a rolled edge to decrease the presentation of any sharp edges of fixture 12, thereby, increasing the safety of fixture 12.

Referring to the bottom portions of FIGS. 2 and 3 (where the bottom three cups 22 have been removed for illustrative purposes) and also to FIG. 4, a plurality of indentations or recesses 42 is defined by support 20. Each indentation 42 extends rearwardly (i.e., toward rear wall portions 36 and 38) from front wall 30. In one example, each indentation 42 is laterally centered on front wall 32 between side walls 34 and 36 and at least partially extends into each side wall 32 and 34. Indentations 42 are each sized and shaped similarly to a corresponding cup 22. In particular, in one embodiment wherein each cup 22 is shaped as a conical frustum, as will be further described below, each indentation 42 is similarly substantially shaped as a conical frustum or portion thereof such that the size of each indentation 42 decreases as it extends from front wall 32 back toward rear wall portions 36 and 38.

An aperture 44 is provided through a center of each indentation 42. In this manner, each aperture 44 provides a passageway from a position external front wall 32 into cavity 40 defined by support 20. In one example, apertures 44 are each sized to receive one bulb cluster 18 (FIG. 1) as will be further described below. In other embodiments, each indentation 42 is substantially or entirely eliminated and each aperture 44 is enlarged to define cut-outs rather than indentations 42 in support 20 where each cut-out is sized to receive a cup 22. Although primarily described below with respect to indentations 42, it should be understood that, in one embodiment, apertures 44 may be enlarged such that indentations 42 are eliminated. In such an embodiment, apertures 44 are sized such that a substantial portion of each cup 22 extends therethrough and into cavity 40.

The spacing and position of each indentation 42 along support 20 is based upon a desired end result and the configuration of display light strand 14 as will become clear below. In one example, indentations 42 are uniformly or evenly spaced longitudinally along support 20. In other embodiments, indentations 42 may be spaced in other configurations (e.g., non-linear and/or non-uniform spacing) adapted to produce a desired end display.

Support 20 is configured for installation in a retail setting at any one of a variety of orientations, such as a vertical orientation, a horizontal orientation, etc. Referring to FIGS. 1 and 3, in one embodiment, a plurality of mounting holes 46 are defined by each side wall 32 and 34. Each mounting hole 46 is configured to facilitate installation of support 20 in a retail setting for use. In one embodiment, the plurality of mounting holes 46 in each side wall 32 and 34 are longitudinally spaced along the length of support 20. Other formations or mechanisms configured to facilitate installation of support 20 in any desired environment are also contemplated.

In one embodiment, where support 20 is configured for installation in a vertical configuration, a base plate 50 is coupled to first end 24 of support 20. Base plate 50 is substantially planar and generally extends with an orientation substantially orthogonal to the longitudinal direction of support 20. In particular, as illustrated with reference to the transverse cross-sectional illustration of FIG. 5, base plate 50 is substantially rectangular and has larger dimensions than the overall transverse cross-sectional dimensions of support 20. Base plate 50 defines a first major surface 52 opposite a second major surface 54.

During assembly, support 20 is substantially positioned on base plate 50 and coupled to first major surface 52. More specifically, in one embodiment, front wall 30 of support 20 is substantially centered laterally and positioned to align with a front edge 56 of base plate 50. Support 20 may be coupled with base plate 50 in any suitable manner, including but not limited to welds, mechanical fasteners and attachment devices, adhesives, or in any other suitable manner.

In one example, first and second pluralities of protrusions or feet 60 and 62 extend from second surface 54 of base plate 50 away from first surface 52 as illustrated with reference to FIGS. 3 and 5. More specifically, in one embodiment, the first plurality of protrusions 60 are arranged in an array and are positioned between first side wall 32 of support 20 and a first side edge 64 of base plate 50. The second plurality of protrusions 62 are arranged in an array similar to the first plurality of protrusions 60 and positioned between second side wall 34 of support 20 and a second side edge 66 of base plate 50 opposite first side edge 64. Each plurality of protrusions 60 and 62 is configured and arranged to correspond with apertures 130 in a retail shelving unit 70 (FIG. 8) as will be further described below.

In one embodiment, the plurality of protrusions 60 and 62 are symmetrically positioned relative to one another on base plate 50. In one example, the arrays formed by the plurality of protrusions 60 and 62 each include four protrusions equally spaced from one another. In one example, each protrusion included in protrusions 60 and 62 has a substantially oblong cross-sectional shape.

In one embodiment, support 20 and base plate 50 are each fabricated from a suitable plastic, such as polystyrene, acrylic, or metal, such as galvanized steel, aluminum, etc. In one embodiment, the support 20 and/or base plate 50 is powder coated to match or otherwise coordinate with other fixtures in a retail store or setting. In one example, support 20 may be formed as a composite of suitable materials and/or members. In other embodiments, support 20 and/or base plate 50 are configured of plastic and may be finished as desired to achieve a desired aesthetic look for a particular display unit 10.

In one embodiment, a single cup 22 is received by each indentation 42. Each cup 22 defines a cavity 90 configured to receive a bulb cluster 18 (FIG. 1) and to at least partially shield the corresponding bulb cluster 18 from the ambient light and/or at least a portion of the light emitted by adjacent bulb clusters 18. Accordingly, each cup 22 is one example of means for shielding one of bulb clusters 18 from ambient light. In one example, the plurality of cups 22 are arranged in a single linear array along support 12. Cups 22 may be any shaped configured to at least partially shield such light. In one example, each cup 22 is substantially shaped as a cone such as a conical frustum. In this manner, a front opening 80 is defined at the largest end of each cup 22. In one embodiment, a rear opening 82 is formed at or near the apex of each cup 22 opposite front opening 80 so as to provide a passage for receiving one of bulb clusters 18 as will be further described below.

In general, front opening 80 has a larger diameter than aperture 44 formed in support 44 such that cup 22 can be retained in position by support 12. In one embodiment, each rear opening 82 has a size similar to or smaller than a size of a corresponding rear aperture 44 formed in support 20. Cups 22 may be formed of any suitable material. In one example, cups 22 are formed of molded polyvinyl chloride (PVC).

A plurality of air vents 84 are formed through each cup 22 to facilitate dissipation of heat, which is generated by lighted bulb clusters 18, from each bulb cluster 18 to the surrounding environment (i.e., to a position external to cup 22). In addition, each cup 22 has a size similar to a corresponding indentation 42 of support 20. In particular, where an indentation 42 is shaped similar to a cone such as a conical frustum, a corresponding cup 22 is also shaped similar to a cone to conform to the shape of indentation 42. In this manner, a side wall 86 of each cup 22 is positioned substantially adjacent to an exterior surface 88 of indentation 42.

In one embodiment, each cup 22 is secured to support 20 with a heat resistant adhesive applied between side wall 86 of cup 22 and exterior surface 88 of indentation 42. In one embodiment, other methods for coupling each cup 22 with support 20 are employed such as friction-fit, snap-fit, fasteners, etc. Upon coupling of cups 22 and base plate 50 to support 20, fixture 12 is substantially assembled and ready to receive display light strand 14.

Figure 6:
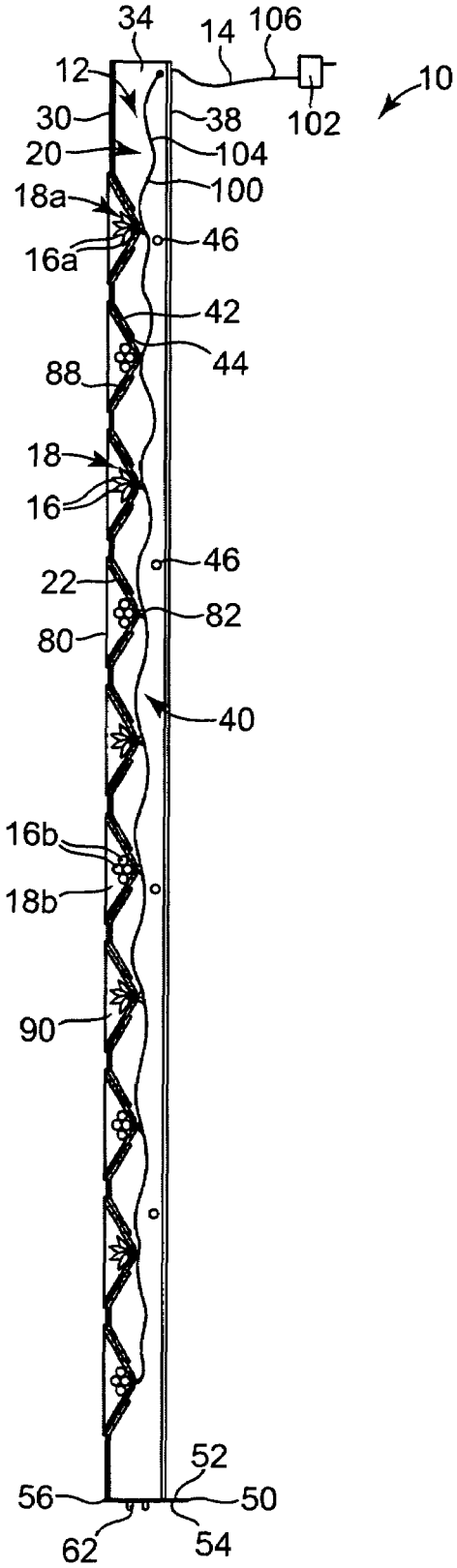
FIG. 6 is a cross-sectional view illustrating the light display unit of FIG. 1 taken along the line of 6-6 in FIG. 1.

Referring to the cross-sectional view of FIG. 6, in one embodiment, display light strand 14 includes a electrical cord 100 electrically coupling each bulb 16 of each bulb cluster 18 to one another. For example, each bulb cluster 18 is electrically connected in parallel with the other bulb clusters 18 via electrical cord 100 such that burn-out of one bulb 16 will not generally affect lighting of other bulbs 16. Each bulb cluster 18 is spaced from adjacent bulb clusters 18 a distance equal to or greater than a distance between two adjacent cups 22, in fixture 12. In one embodiment, electrical cord 100 is formed of more than one wire (not shown) twisted together or laid parallel and otherwise connected to one another. In this manner, even when formed of several wires, electrical cord 100 can be handled as a single unit to decrease tangling with other wires or cords (not shown), if any.

Figure 8:
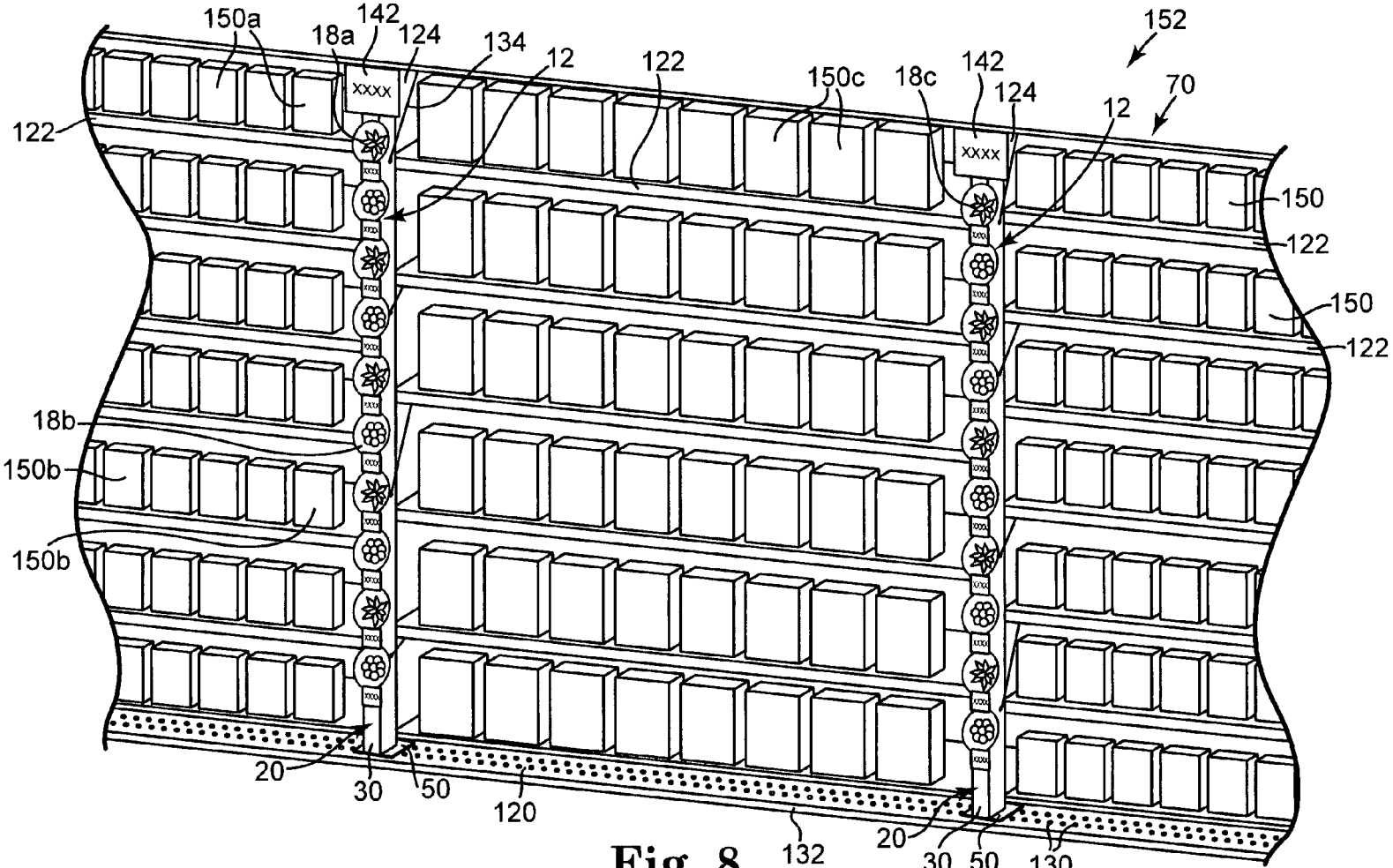
FIG. 8 is a perspective view illustrating one embodiment of a retail display system including light display units and a retail shelving unit, according to the present invention.

In one embodiment, each bulb cluster 18 corresponds to a different for-sale light strand (see, for example, the for-sale light strand boxes 150 generally indicated in FIG. 8) being offered for retail sale. For example, where a retail setting sells a for-sale light strand including only clear elongated bulbs, a corresponding bulb cluster 18*a* only includes bulbs 16*a* that are clear and elongated; where a retail setting sells a for-sale light strand including various colors of round frosted bulbs, a corresponding bulb cluster 18*b* only includes various colored bulbs 16*b* that are round and frosted; and so on and so forth. In one embodiment, bulb cluster 18*a* includes both red and green light bulbs 16*a* where a corresponding for-sale light strand includes both red and green light bulbs. In one embodiment, bulb cluster 18*b* includes both yellow and purple light bulbs 16*b* where a corresponding for-sale light strand includes both yellow and purple light bulbs. With this in mind, in one embodiment, no two bulb clusters 18 of display light strand 14 are the same. In other embodiments, two or more bulb clusters 18 of display light strand 14 may be identical.

In one embodiment, electrical cord 100 terminates in a single electrical plug or connector 102. Connector 102 is configured to interface with a power supply such as an alternating current outlet, a transformer, or other means for providing electricity. In this manner, a single electrical cord 100 is used to provide power to each of the bulb clusters 18 even where each bulb cluster 18 corresponds to a different type of for-sale light strand 150 (generally indicated in FIG. 8) available for retail sale. In one example, electrical cord 100 includes a first portion 104 and a second portion 106 (FIG. 6). First portion 104 terminates in an electrical fitting generally indicated at 108. Electrical fitting 108 is configured to selectively receive second portion 106 of electrical cord 100, which extends to plug 102 or otherwise terminates at a transformer or power source (not shown). The dual-portion electrical cord 100 permits for ease of shipping and storing of assembled display unit 10 where second portion 106 of electrical cord 100 is subsequently coupled with electrical fitting 108 to provide power to bulbs 18. In one example, electrical cord 100 is continuous as electrical cord 100 extends from bulb clusters 18 to plug 102.

In one embodiment, due to the configuration of display light strand 14 to include a plurality of different clusters 18, display light strand 14 may be particularly or specifically manufactured for display purposes and strands similar to display light strand 14 likely are not offered for retail sale. By specifically designing display light strand 14 for display, a plurality of types of bulb clusters 18 can be displayed without the entanglement of a plurality of cords where a different cord extends from each bulb cluster 18 as is typical in the prior art.

In one embodiment, rather than including all of the plurality of bulb clusters 18 on a single electrical cord 100, a plurality of electrical cords 100 may be provided where each electrical cord 100 includes one or more bulb clusters 18. By providing multiple electrical cords 100, more flexibility is provided regarding the order and arrangement that the bulb clusters 18 are placed within the fixture 12 and/or placed in a retail environment as will become apparent from the description below.

Upon assembly, display light strand 14 is coupled with fixture 12. Display light strand 14 is positioned at least partially within cavity 40 of support 20. More specifically, electrical cord 100 longitudinally extends within cavity 40 and each bulb cluster 18 is threaded through rear aperture 44 of an indention 42 and rear opening 82 of a corresponding cup 22 into cup cavity 90. Adjacent bulb clusters 18 are positioned to extend into adjacent cups 22. In one embodiment, a suitable coupling member or other fastener (not shown) is included within or near rear aperture 44 of indentation 42 to securely hold each bulb cluster 18 in place within cup cavity 90. In one embodiment, where more than one electrical cord 100 is used to provide the plurality of bulb clusters 18, each electrical cord 100 is positioned at least partially within cavity 40 as will be apparent to those of skill in the art.

In one embodiment, each bulb cluster 18 is spaced along electrical cord 100 from an adjacent bulb cluster 18 a distance that is greater than a distance between adjacent apertures 44 on support 20. In this respect, bulb clusters 18 are spaced along electrical cord 100 such that, upon assembly, each bulb cluster 18 can be positioned through aperture 44 while still allowing for some slack of electrical cord 100. The slack in electrical cord 100 generally decreases tension in the electrical cord 100, which decreases the probability that a bulb cluster 18 will inadvertently be pulled out of its respective cup 22 due to excessive tension in electrical cord 100. In one embodiment, the placement of bulb clusters 18 and the remainder of display light strand 14 within cavity 40 of support 20 is simplified by access slot 28 of support 20. In particular, access slot 28 is sized to allow an individual to reach through access slot 28 into cavity 40 to interact with display light strand 14 during assembly.

Once all bulb clusters 18 are properly positioned relative to fixture 12, each bulb cluster 18 is viewable at least from in front of fixture 12. In one example, electrical cord 100 extends out of support 20 (such as via access slot 28) a distance sufficient to allow connector 102 to reach an electrical power source (not shown) such as an alternating current source, a transformer, battery pack, etc. Electrical cord 100 can be configured and positioned to extend out of first end 24, second end 26, or any part of support 20 therebetween as required to interface with the electrical power source.

Figure 7:
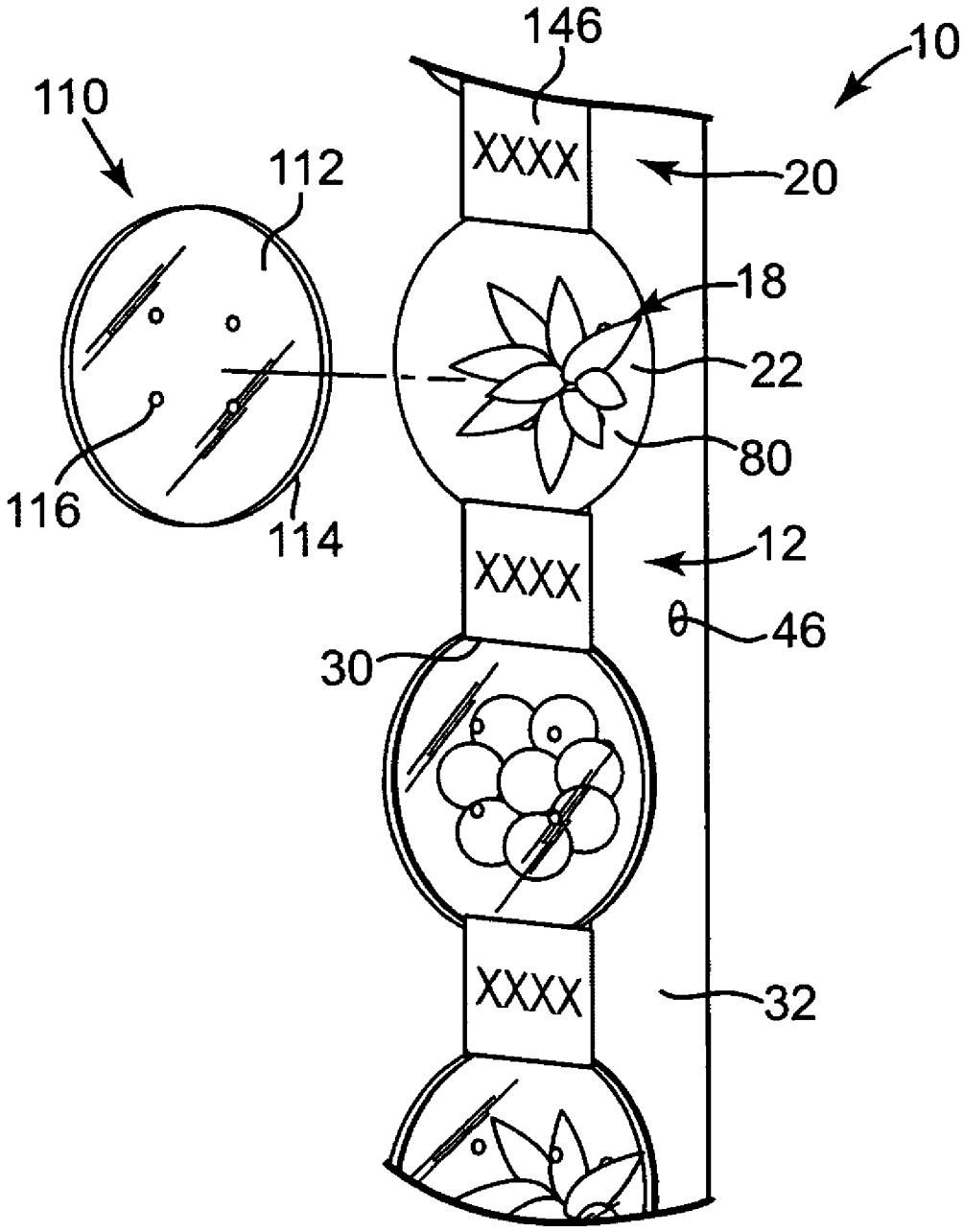
FIG. 7 is a detailed view of one embodiment of the light display unit of FIG. 1 with a plurality of covers, according to the present invention.

Referring to FIG. 7, in one embodiment, a plurality of covers or lids 110 are provided. Each cover 110 may serve a plurality of purposes such as to protect bulb clusters 18 from dust, other contaminates, etc., and/or to discourage a consumer or other individual from contacting bulbs 16, or the sockets (not shown) associated therewith. Discouraging individuals from contacting bulbs 16 and/or sockets, accordingly, prevents or at least decreases the probability that the corresponding individual will suffer burns or electrical shock due to interaction with display unit 10. In view of the above, covers 110 are examples of means for protecting bulb clusters 18.

In one example, each cover 110 is configured to fit over front opening 80 of a corresponding cup 22. Accordingly, each cover 110 is at least partially transparent such that cover 110 does not block or otherwise substantially interfere with viewing of bulb clusters 18 within cups 22. For instance, cover 110 may include a circular major surface 112 sized similar to but slightly larger than cup 22 near opening 80. A lip or flange 114 extends about a perimeter of major surface 112. Cover 110 is placed over cup 22 and covers opening 80 via friction fit or other suitable manner of attachment. In one embodiment, major surface 112 defines one or more holes 116 configured to dissipate heat from lighted bulbs 16 within the corresponding cups 22 to the surrounding environment. In one example, cover 110 is formed of a single transparent polymeric material or other suitable transparent material.

To further enhance display of bulbs 16, in one embodiment, one or more signs are added to light display unit 10. In one embodiment, a sign 142 is coupled to front wall 30 of support 20 near second end 26 (i.e. over bulb clusters 18 when display unit is in a vertical configuration) and includes indicia 144. Indicia 144 may be any suitable design, message, etc. consistent with the overall aesthetic plan for a retail setting. In one embodiment, indicia 144 indicates a type of bulb finish such as faceted, pearl, clear, etc. where each bulb 16 included in light display unit 10 is the particular bulb finish indicated. Additional signs 146 may also be coupled to front wall 30 between cups 22 including indicia 148 identifying what type of for-sale light strand is represented by an adjacent bulb cluster 18. As such, signs 142 and 146 assist potential consumers in identifying what for-sale light strand they wish to purchase.

In one example, signs 146 are appropriately sized to assist in coupling each cup 22 with support 12. For instance, signs 146 may be sized to at least partially overlap each adjacent cup 22 such that each cup 22 is at least partially maintained between front wall 30 of support 12 and a corresponding sign 146. In one embodiment, no signs 142 or 146 are coupled with light display unit 10.

Referring to FIG. 8, in one embodiment, light display unit 10 is coupled to a retail shelving unit 70 to form a retail display system 152. In one example, retail shelving unit 70 includes a base deck 120, a plurality of display shelves 122, and one or more vertical divider walls 124. Base deck 120 is generally positioned on a floor (not shown) of the retail setting and is configured to at least partially support the remainder of retail shelving unit 70. At least one divider wall 124 extends vertically from the top of base deck 120. Each display shelf 122 extends from or between divider wall(s) 124 with an orientation substantially parallel to base deck 120 and is configured to support products being sold at the retail setting.

In one embodiment, a plurality of apertures 130 are defined by base deck 120 and extend along and substantially parallel with a front edge 132 of base deck 120. In one example, where light display unit 10 is vertically oriented, coupling of light display unit 10 to shelving unit 70 includes placing base plate 50 of fixture 12 on base deck 120. More specifically, base plate 50 is positioned such that each of the pluralities of protrusions 60 and 62 (FIGS. 1-3) extending therefrom fit within a corresponding plurality of apertures 130 in base deck 120 to at least partially secure fixture 12 to base deck 120. In one embodiment, fixture 12 is more securely coupled to base deck 120 as opposed to other portions of retail display system 152 to withstand any incidental contact of shopping carts or other generally low moving objects or persons.

In one embodiment, fixture 12 is coupled with base deck 120 in a position to align with one of divider walls 124 to at least partially hide the corresponding divider wall 124 from view by a consumer. In one embodiment, fixture 12 is vertically positioned to extend in front of display shelves 122. By vertically positioning light display unit 10 in front of display shelves 122, light display unit 10 generally does not require space on any of display shelves 122. In this manner, light display unit 10 does not substantially alter the amount of space available on display shelves 122 for receiving products such as for-sale light strands 150.

Further, a width of light display unit 10, whether defined by cups 22 or signs 146 is generally slim so as not to substantially block consumer viewing of products such as for-sale light strands 150 positioned on display shelves 122 near light display unit 10 or removal of such products from display shelves 122. In one embodiment, the positioning of light display unit 10 increases the aesthetic appeal of retail display system 152 by dividing the overall display of for-sale light strands 150 and other associated products into conceptually manageable parts that can be more easily processed by the consumer. In this manner, light display unit 10 functions similar to a header in a lengthy written document to help focus and direct the consumer to the areas of retail display system 152 in which the consumer is interested, etc.

Figure 9:
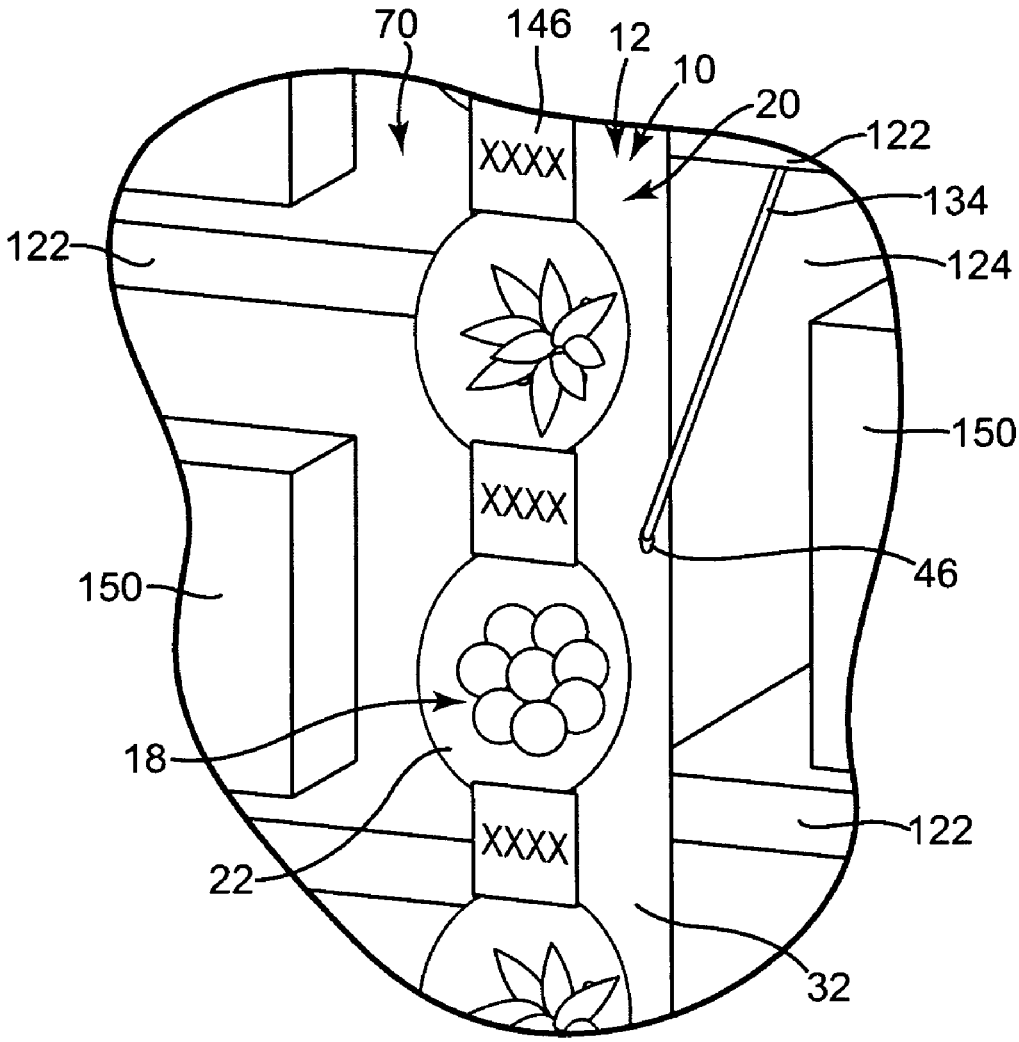
FIG. 9 is a detailed view at least partially illustrating one embodiment of the connection of one of the light display units to a retail shelving unit of FIG. 8, according to the present invention.

As illustrated with reference to FIG. 9, to further secure light display unit 10 to shelving unit 70, in one embodiment, a fastening strap 134 is coupled with support 20 via one of side mounting holes 46. More particularly, fastening strap 134 extends from side mounting hole 46 to interface with one or more of a display shelf 122 and divider wall 124. In one example, fastening strap 134 is secured to a display shelf 122 positioned further away from base deck 120 than the corresponding side mounting hole 46 from which it extends. Any suitable number or position of fastening straps 134 may be used to further secure light display unit 10 to shelving unit 70 to prevent tipping of or other undesired displacement of light display unit 10 relative to shelving unit 70. Fastening strap 134 may be any suitable device, such as a cable tie, a string, a chain, a cable, etc. In one embodiment, other means for coupling light display unit 70 to shelving unit 70 may be used in addition to or as an alternative to base deck apertures 130 and fastening strap(s) 134. In view of the above, base plate 50 and fastening strap 134 are examples of means for coupling fixture 12 to a portion of retail display system 152.

Figure 10:
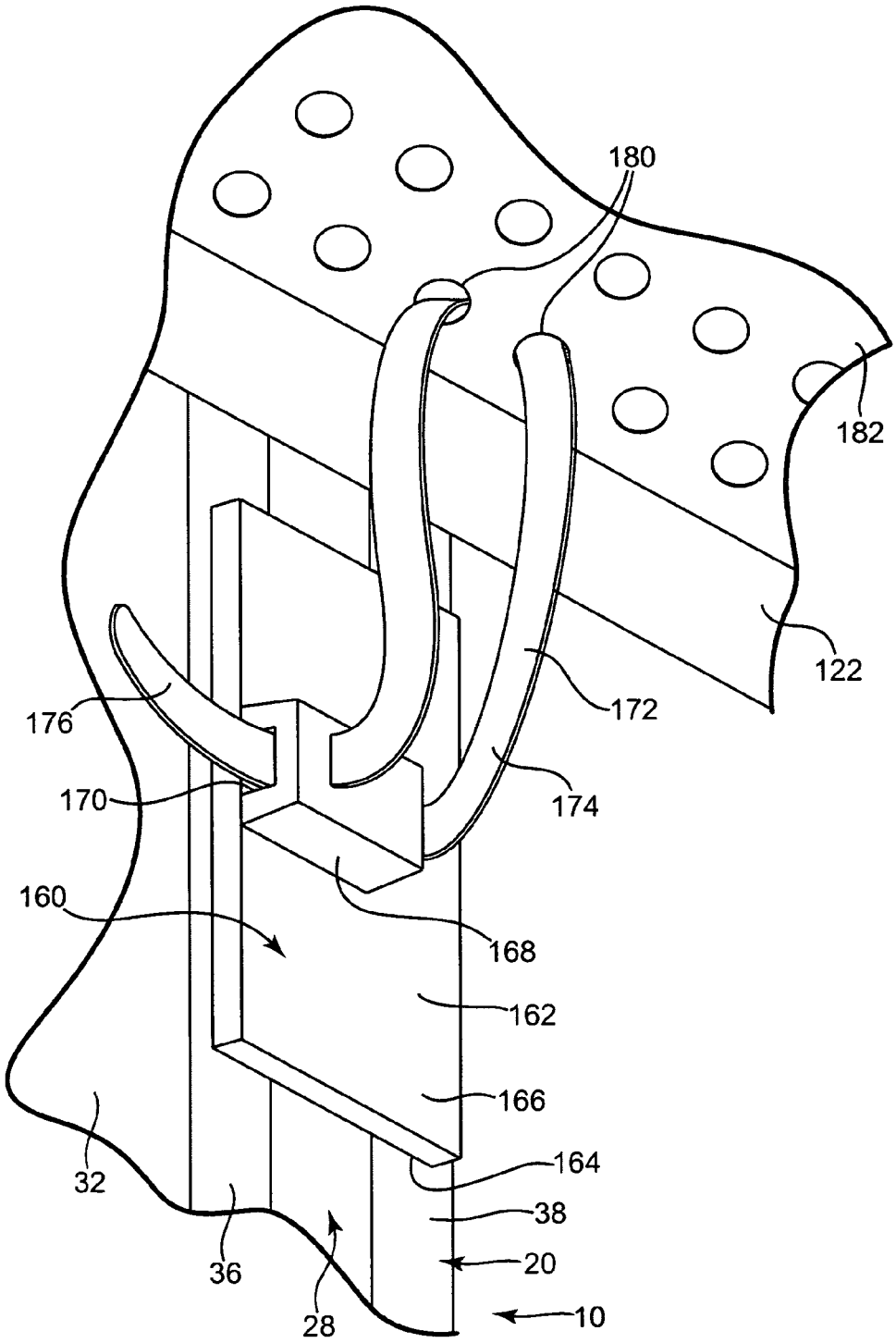
FIG. 10 is a bottom perspective view illustrating a portion of one embodiment of the light display fixture of FIG. 1 coupled to a retail shelf, according to the present invention.

As illustrated in the bottom, rear perspective view of FIG. 10, in one embodiment, other means such as a mount 160 for coupling light display unit 10 to one or more display shelves 122 may additionally or alternatively be employed. In FIG. 10, mount 160 is illustrated as coupling support 20 of light display unit 10 to a shelf 122 without a divider wall 124 (FIG. 8) for clarity. However, it should be understood that mount 160 could also be used with a divider wall 124 as will be apparent to those of skill in the art.

Mount 160 includes a rectangular mounting plate 162 defining a generally planar first surface 164 opposite a second generally planar surface 166. First surface 164 is configured to be coupled with rear wall portions 36 and 38 of support 20 with an adhesive, mechanical fastener, or any other suitable fixing agent. A mounting block 168 extends rearwardly from second surface 166 of mounting plate 160 and defines a cavity 170 extending therethrough. A first end 172 of a fastening strap 174 is rigidly secured to mounting block 168, and cavity 170 is configured to receive a second end 176 of fastening strap 174. Cavity 170 is configured to interact with fastening strap 174 to secure fastening strap 174 in a desired position relative to mounting block 168. In one embodiment, fastening strap 174 is any suitable device, such as a cable tie, a string, a chain, a cable, etc.

In particular, in one embodiment, fastening strap 174 extends from first end 172 through two of a plurality of apertures 180 formed in a horizontal member 182 of display shelf 122. From the second of the two apertures 180, fastening strap 174 extends back toward and through cavity 170 of mounting block 168. As such, second end 176 of fastening strap 174 is pulled to tightened fastening strap 174 within cavity 170, which securely positions support 20 relative to display shelf 122. In other embodiments, no mount 160 is provided and fastening strap 174 is threaded through side mounting holes 146 of support 20 (FIG. 9) to interface with apertures 180 of shelf 122 as will be apparent to those of skill in the art. In view of the above, mount 160 and fastening strap 174 are examples of means for coupling fixture 12 to a portion of retail display system 152. Other techniques and devices for mounting display unit 10 within retail display system 152 are also contemplated.

Referring once again to FIG. 8, as described above, in one embodiment, each bulb cluster 18 corresponds to a particular for-sale light strand configuration, generally indicated as boxed for-sale light strands at 150, available for purchase from the retail setting. In one embodiment, for-sale light strands 150 are arranged on and supported by the display shelves 122 of shelving unit 70. More specifically, in one embodiment, for-sale light strands 150 are positioned in shelving unit 70 to be proximate to the corresponding bulb cluster 18. For example, where a bulb cluster 18*a* is positioned near the second end 26 of support 20, the corresponding for-sale light strands 150*a* are positioned nearby bulb cluster 18*a*. Similarly, for-sale light strands 150*b* are positioned near bulb cluster 18*b*, etc.

Furthermore, in one embodiment, each for-sale light strand 150 includes indicia (not shown) visually illustrating the light bulbs of the one-sale light strand 150 and/or other demarcation(s) corresponding to a particular bulb cluster 18 of the display unit 10 or a sign 144 and/or 146 (FIG. 1) associated therewith. In one example, signs 144 and/or 146 and/or indicia on for-sale light strands 150 facilitate consumer identification of which for-sale light strand 150 corresponds to a particular bulb cluster 18 of the light display unit 10. In this manner, not only does light display unit 10 provide an attractive and eye-catching means for displaying light bulbs 16, but display of bulb clusters 18 in light display unit 10 also encourages consumer purchase of one of the corresponding for-sale light strands 150. Since the selection of for-sale light strands 150 being offered in a particular retail setting generally changes with time and/or from season to season, in one embodiment, the entire light display unit 10 is disposable such that a new light display unit 10 can be provided to correspond with new selections of for-sale light strands 150.

In one embodiment, more than one light display unit 10 may be coupled with a shelving unit 70. The multiple light display units 10, in one embodiment, each display different bulb clusters 18 than other display units 10. As such, by increasing the number of light display units 10 the types of bulbs 16 displayed is also increased. The second display unit 10 is similarly positioned relative to corresponding for-sale light strands 150 so as to positionally associate a type of for-sale light strand 150 with a type of bulb cluster 18. For example, where a bulb cluster 18*c* is positioned near the second end 26 of support 20 of a second light display unit 10, the corresponding for-sale light strands 150*c* are positioned nearby bulb cluster 18*c*.

Figure 11:
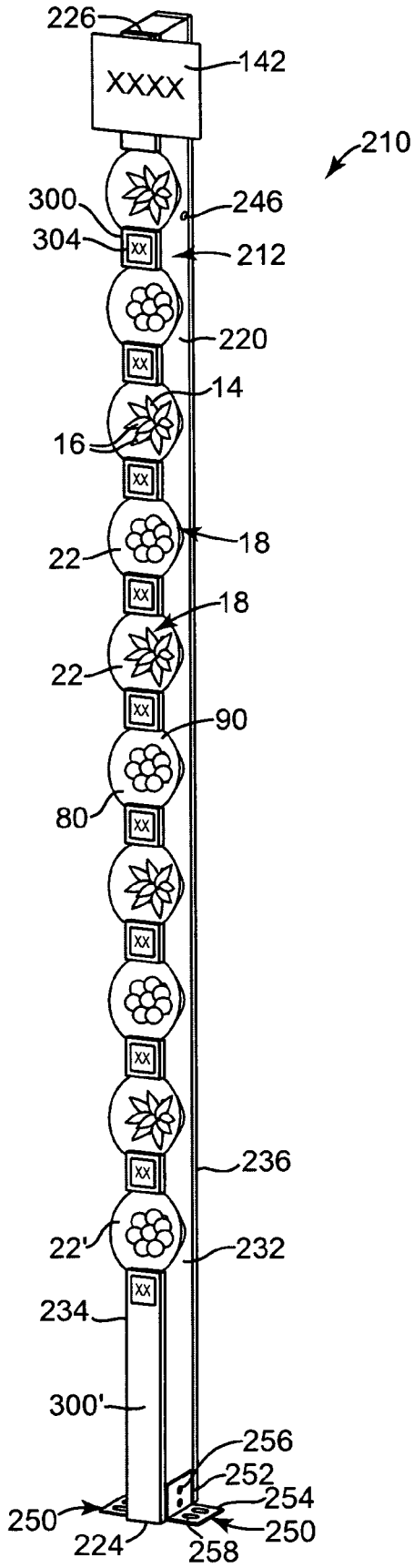
FIG. 11 is perspective view illustrating one embodiment of a light display unit, according to the present invention.

FIG. 11 illustrates one embodiment of a light display unit 210 similar to light display unit 10 (FIG. 1) except where specifically enumerated herein. Light display unit 210 includes a fixture 212 and display light strand 14. In one embodiment, fixture 212 includes a support 220 and a plurality of cups 22. Support 220 may be formed in any one of a plurality of configurations. In one embodiment, support 220 is generally elongated and defines a first end 224 and a second end 226 opposite first end 224. As illustrated with additional reference to FIG. 12, in one example, support 220 has a generally rectangular or U-shaped transverse cross section and is open to a front portion thereof.

More specifically, in one embodiment, support 210 is collectively defined by a first side wall 232, a second side wall 234, and a rear wall 236. First and second side walls 232 and 234 are generally positioned spaced from and parallel to one another. Rear wall 236 extends between and is coupled to rear edges of first and second side walls 232 and 234. In this manner, each side wall 232 and 234 defines a front edge 241 and 244, respectively, opposite rear wall 236. In this manner, support 220 defines an opening 238 at a front portion thereof.

Each wall 232, 234, and 236 extends along a substantial length of support 220 between first end 224 ands second end 226 to define a cavity 240 therebetween. In one embodiment, each of walls 232, 234, and 236 are separately formed from any suitable material and coupled to one another with an adhesive, mechanical fastener, or any other suitable fastening agent. In one embodiment, walls 232, 234, and 236 are formed as a single piece.

Side wall 232 defines a plurality of cutouts 242 extending from front edge 241 toward rear wall 236. Each cutout 242 is sized and shaped to facilitate receiving one of the plurality of cups 22, as will be further described below. In one embodiment, each cutout 242 is substantially triangularly shaped. As such, each of the cutouts 242 is spaced from each other along a length of support 220 as desired for spacing cups 22. Second side wall 234 defines a plurality of cutouts 245 sized, shaped, and spaced from each other similar to cutouts 242 of first side wall 232. In one embodiment, each of cutouts 242 is positioned on first side wall 232 to generally laterally align with a respective one of cutouts 245 of second side wall 234 and form an aligned pair of cutouts 242 and 245. In one embodiment, adjacent pairs of cutouts 242 and 245 respectively define substantially linear portions 243 and 246 of front edges 241 and 244 therebetween.

In one embodiment, support 220 is configured for installation in a retail setting at any one of a variety of orientations, such as a vertical orientation, a horizontal orientation, etc. Referring to FIG. 11, in one embodiment, at least one mounting hole 246 is defined by each side wall 232 and 234. Each mounting hole 246 is configured to facilitate installation of support 220 in a retail setting for use in a manner similar to that described above with respect to mounting holes 46 of support 20 (FIGS. 1 and 9). In one embodiment, a mount 160 (FIG. 10) is additionally or alternatively secured to rear wall 236 to couple support 220 in a display similar to retail display system 152 (FIG. 8) described above.

In one embodiment, where support 220 is configured for installation in a vertical configuration, two or more mounting brackets 250 are coupled to first end 224 of support 220. Each mounting bracket 250 is generally L-shaped and defines a first member 252 extending generally perpendicularly from a second, bottom member 254. In one embodiment, first member 252 is generally planar and extends with an orientation substantially parallel to the longitudinal direction of support 220 while second member 254 is generally planer and extends with an orientation generally orthogonal to the longitudinal direction of support 220.

In one embodiment, first member 252 is coupled with first side wall 232 of support 220 via any suitable fastening agent (s) 256, such as a screw, clip, rivet, adhesive, etc. In one embodiment, second member 254 defines apertures 258 or other suitable means to facilitate coupling of support 220 with base deck 120 (FIG. 8), as will further be described below. In one embodiment, support 220 and/or mounting brackets 250 are fabricated from a suitable plastic, such as polystyrene, acrylic, or metal, such as galvanized steel, aluminum, etc.

Figure 12:
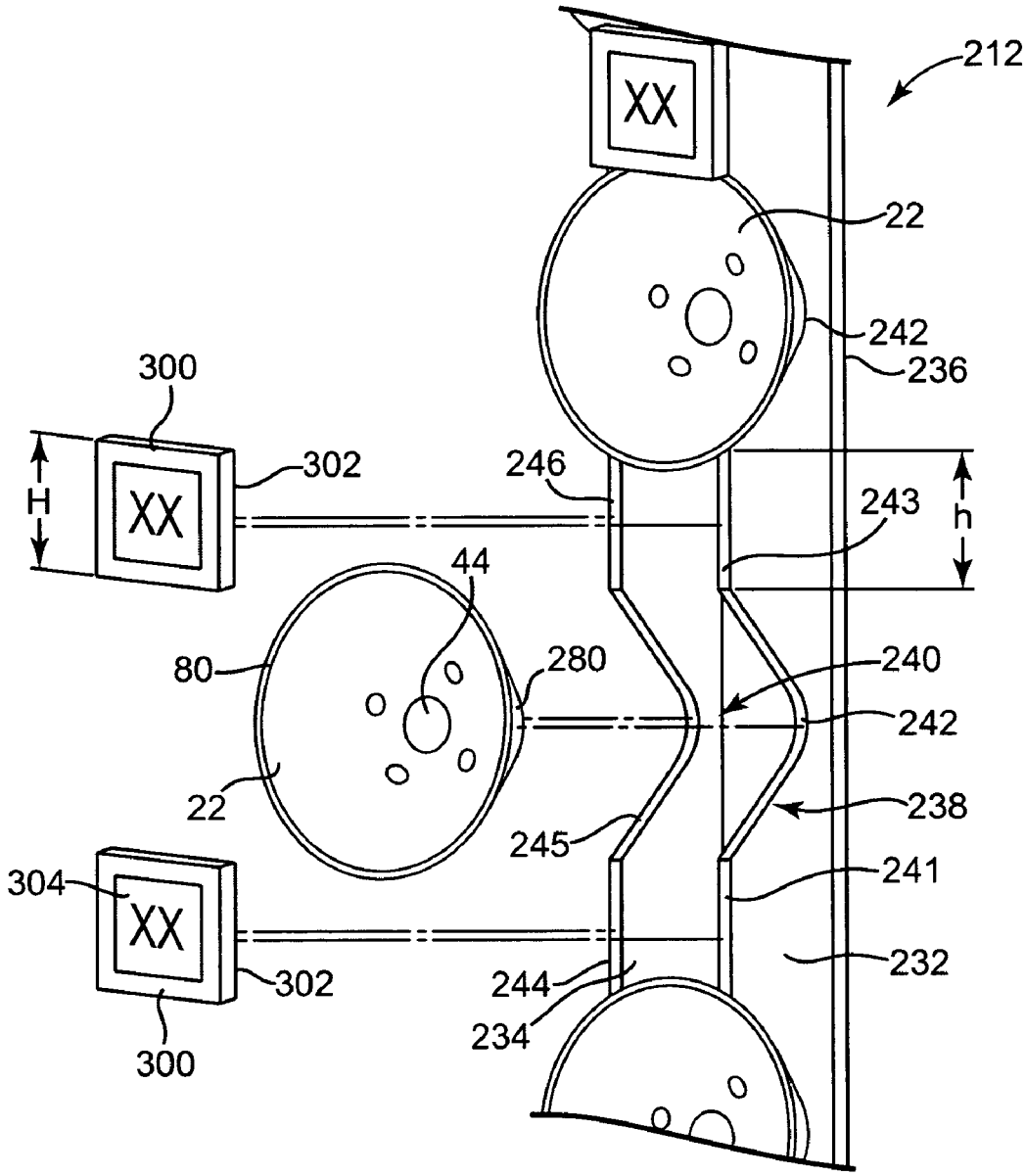
FIG. 12 is a detailed, partially exploded view of one embodiment of the light display unit of FIG. 10 without a light strand, according to the present invention.

Referring to FIG. 12, in one embodiment, a single cup 22 is received by each aligned pair of cutouts 242 and 245. In this manner, each cup 22 has a size similar to a corresponding aligned pair of cutouts 242 and 245 of support 220 such that an outer surface 280 of each cup 22 interfaces with each corresponding cutout 242 and 245. It should be noted that during assembly, light strand 14 (FIG. 11) is placed within cavity 240 prior to positioning of cups 22 relative to support 220 to allow manipulation of light strand 14 to position adjacent bulb clusters 18 to extend from cavity 240 through rear apertures 44 of adjacent cups 22 as will be apparent based on the above described assembly of light display unit 10 (FIG. 1). However, in FIG. 12, the assembly of fixture 212 is illustrated without light strand 14 for clarity.

In one embodiment, following placement of each cup 22 to interface with an aligned pair of cutouts 242 and 245, cups 22 are coupled with support 220 using front plates 300. Each front plate 300 is configured to extend across a front portion of support 220 to interface and be coupled with an aligned pair of linear portions 243 and 246 of front edges 241 and 244. In one example, one or more of front plates 300 is sized with a height H greater than a height h of respective linear portions 243 and 246. As such, each front plate 200 extends at least slightly beyond linear portions 243 and 246 and over a portion of an adjacent cup 22 near front opening 80 of the adjacent cup 22. In this manner, when coupled with support 220, a rear surface 302 of each front plate 300 interfaces with an adjacent cup 22 to maintain or lock the adjacent cup 22 between any adjacent front plates 300 and front edges 241 and 244, more particularly, cutouts 242 and 245. Cup 22 can alternatively be coupled with support 220 in any other suitable manner.

In one example, as illustrated in FIG. 11, the bottom-most cup 22' is spaced considerably further from the first end 224 of support 220 than from an adjacent cup 22. Mores specifically, the bottom-most cup 22' is spaced from first end 224 to generally decreases strain on a consumer who otherwise may need to bend or otherwise crouch to view bulb cluster 18 in bottom-most cup 22'. In addition, by spacing bottom-most cup 22' up from first end 224 more clearance is provided for shopping carts, children, and/or other low moving objects or persons that may otherwise be more prone to inadvertently contact fixture 212. Accordingly, to cover front opening 238 to cavity 240, the bottom-most front plate 300' may be elongated in comparison to one or more of the other front plates 300 to extend from first end 224 of support 220 to interface with the bottom-most cup 22'. In one embodiment, light display unit 10 is assembled, opening 238 is substantially covered such that cavity 240 is substantially enclosed at least from the front, rear, and sides of support 220. In one embodiment, a substantially enclosed cavity 240 prevents or at least decreases tampering with light strand 14 maintained at least partially therein.

To further enhance display of bulb clusters 18, in one embodiment, one or more labels 304 are added to light display unit 210. In one embodiment, labels 304 are each coupled to one of front plates 300 such that front plates 300 not only serve to couple cups 22 to support 220 but also function as signs similar to signs 146 (FIG. 1). In one embodiment, each label 304 is a label affixed to a corresponding front plate 300. In one embodiment, front plates 300 are printed with identifying information, such that each front plate 300 is a sign in and of itself, such that a separate label 304 may be eliminated or replaced. As such, front plates 300 include indicia configured to assist in delivering any suitable design, message, etc. consistent with the overall aesthetic plan for a retail setting to consumers. In one embodiment, front plates 300 and/or labels 304 included thereon indicate a type of bulb finish such as faceted, pearl, clear, etc. where each bulb 16 included in light display unit 10 is the particular bulb finish indicated. As such, front plates 300 and/or labels 304 assist potential consumers in identifying what for-sale light strand 150 (FIG. 8) they wish to purchase.

In one embodiment, covers or lids such as covers 110 of light display unit 10 (FIG. 7) may be placed on each respective cup 22 prior to placing a cup 22 between front edges 241 and 244 of support 220 and front plates 300 to protect light clusters 18 (FIG. 11) from dust, other contaminates, etc. and/or to discourage a consumer or other individual from contacting bulbs 16, or the sockets (not shown) associated therewith.

Light display unit 210 can be incorporated into a retail display system in any manner, such as similar to light display unit 10 in retail display system 152 of FIG. 8, or coupled to a retail shelf similar to light display unit 10 to display shelf 122 in FIG. 10. In one embodiment, light display unit 210 is coupled with base deck 120 (FIG. 8) by inserting a fastening member, such as a screw, clip, etc., through an aperture 258 of bracket 250 and into an aperture 130 (FIG. 8) of base deck 120. In addition, fastening straps 134 (FIG. 9), mounts 160 (FIG. 10), and or other means for coupling support 220 to retail display system 152 may additionally or alternatively be employed.

Other manners of using light display units 10 and 210 in a retail setting will be apparent to those of skill in the art. In addition, in other embodiments, light display units 10 and 210 may be adapted for use in other settings including non-retail settings. Light display units 10 and 210 may be formed in any variety of shapes and sized to serve a particular purpose. For example, cups 22 may be positioned in a non-linear array, etc. Furthermore, when used in a non-retail setting, the bulb clusters 18 of light display units 10 and 210 may all be substantially identical or otherwise coordinate.

Although specific embodiments have been illustrated and described herein, it will be appreciated by those of ordinary skill in the art that a variety of alternate and/or equivalent implementations may be substituted for the specific embodiments shown and described without departing from the scope of the present invention. For example, the components of light display unit 10 can generally supplement and/or be substituted for one or more components of light display unit 210 and vice versa. This application is intended to cover any adaptations or variations of the specific embodiments discussed herein. Therefore, it is intended that this invention be limited only by the claims and the equivalents thereof.

What is claimed is:

1. A light display unit comprising:

a display fixture including:

an elongated support defining a chamber and a plurality of indentations extending from an external surface of the support, wherein an opening is defined within each of the plurality of indentations and provides access to the chamber;

a plurality of receptacles formed separately from and coupled to the support, wherein each of the plurality of receptacles is positioned within a different one of the plurality of indentations and each receptacle defines an aperture aligned with the opening of the support such that the aperture is in communication with the chamber of the support; and a light strand including:

an electrical cord including a first end configured to be coupled with an electrical power source, and a plurality of bulb groupings being in electrical communication with the electrical cord, the plurality of bulb groupings including at least two different combinations of light bulbs; wherein the electrical cord is at least partially housed in the chamber of the display fixture and extends into each of the plurality of receptacles of the support through the openings of the support and the apertures of the receptacles such that each of the plurality of bulb groupings is positioned within a different one of the plurality of receptacles; and at least one sign coupled with the support, the at least one sign indicating a type of light bulb housed in at least one of the receptacles and facilitating coupling of the at least one of the receptacles to the support by interposing the at least one of the receptacles between the support and the at least one sign.

2. The light display unit of claim 1, in combination with a plurality of for-sale light strands, wherein each bulb grouping includes light bulbs representative of a plurality of light bulbs included as part of a different corresponding one of the plurality of for-sale light strands, and the at least one sign links each bulb grouping to the corresponding one of the for-sale light strands.

3. The light display unit of claim 1, wherein the electrical cord is the only electrical means coupling the plurality of bulb groupings to one another.

4. The light display unit of claim 1, wherein the external surface is a front external surface, the support defines a rear external surface, which is opposite the front external surface, and the opening provides access to the chamber through the rear external surface of the support.

5. A display fixture configured to receive a light strand, the display fixture comprising:

an elongated support defining a cavity, which is configured to accommodate at least a portion of the light strand, and including two generally parallel side walls collectively defining a plurality of pairs of cutouts, each cutout extending through an entire thickness of a corresponding one of the two generally planar side walls;

a plurality of cups formed separately from and coupled to the support such that each of the pairs of cutouts receives one of the plurality of cups, each of the cups defining a front aperture and a rear aperture opposite the front aperture; and a plurality of front plates coupled with the support and each overlapping at least an adjacent one of the plurality of cups such that at least the adjacent one of the plurality of cups is secured between the support and at least one of the front plates due to interaction with each of the support and the at least one of the front plates;

wherein the cavity is accessible through the rear aperture of each of the plurality of cups to accommodate passage of at least a portion of the light strand from the cavity through one of the plurality of rear apertures into one of the plurality of cups.

6. The display fixture of claim 5, wherein each of the plurality of cups is substantially cone shaped and each of the cutouts is substantially triangular shaped.

7. The display fixture of claim 5, wherein the support is a substantially linear member.

8. The display fixture of claim 5, wherein each cup defines one or more vents.

9. The display fixture of claim 5, wherein the plurality of cups are arranged in a single linear array.

10. The display fixture of claim 5, wherein the support has a generally U-shaped transverse cross section.

11. The display fixture of claim 5, further comprising a plurality of substantially transparent covers each extending over one of the plurality of cups opposite the support.

12. The display fixture of claim 5, wherein the display fixture is configured to display the light strand in a retail setting, each of the plurality of cups is configured to receive a different grouping of light bulbs included on the light strand, and each of the plurality of cups is substantially opaque and positioned to shield the different grouping of light bulbs received therein from ambient light and from other light emitted by the light strand such that the light bulbs can be displayed in a manner more nearly representing actual use of the light bulbs following retail sale.

13. A display unit comprising:

a plurality of light bulb clusters;

means for maintaining the plurality of light bulb clusters spaced from one another, the means for maintaining including:

a support defining front edges, means for at least partially shielding one of the plurality of bulb clusters from ambient light, wherein a separate means for at least partially shielding is associated with each of the plurality of light bulb clusters, each separate means for at least partially shielding including a rear aperture for receiving one of the plurality of light bulb clusters and a front aperture opposite the rear aperture and being spaced along the support from other ones of the separate means for at least partially shielding, and a plurality of front plates coupled with the front edges of the support, each of the plurality of front plates overlapping at least an adjacent one of the separate means for at least partially shielding such that at least the adjacent one of the separate means for at least partially shielding is secured between the support and at least one of the plurality of front plates due to interaction with each of the support and the at least one of the plurality of front plates;

means for coupling the means for maintaining to a portion of a retail display system; and means for protecting each of the plurality of light bulb clusters, the means for protecting being coupled with the means for at least partially shielding one of the plurality of light bulb clusters such that the means for protecting extends around and contacts an outer perimeter defined around the front opening by the means for at least partially shielding.

14. The display unit of claim 13, wherein the means for coupling positions the means for maintaining to extend in front of a plurality of shelves included in the retail display system.

15. The display unit of claim 13, wherein the plurality of light bulb clusters are each coupled to one another with a single electrical cord, each of the plurality of light bulb clusters corresponds with a visually different one of a plurality of for-sale light strands positioned for retail sale near the display unit, the single electrical cord is substantially placed and visually hidden within the means for maintaining, and the separate means for at least partially shielding are each molded from a plastic material.

16. The display unit of claim 15, in combination with the plurality of for-sale light strands.

17. A method of displaying lights, the method comprising:

displaying a plurality of packaged strands of light for retail sale;

providing a fixture including a support with a plurality of receptacles extending from the support and spaced from one another, wherein the support defines a cavity and includes two generally parallel side walls collectively defining a plurality of pairs of cutouts, each cutout extends through an entire thickness of a corresponding one of the two generally planar side walls, the plurality of receptacles are formed separately from and coupled to the support such that each of the pairs of cutouts receives one of the plurality of receptacles, each one of the plurality of receptacles defines a front aperture and a rear aperture opposite the front aperture, the cavity is accessible through the rear aperture of each of the plurality of receptacles, each of the two generally parallel side walls defines a front edge, the fixture further comprises a front plate, and the front plate is coupled to and extends between the front edges of the two generally parallel side walls and extends in front of an adjacent one of the plurality of receptacles to interpose the adjacent one of the plurality of receptacles between the support and the front plate in a manner securing the adjacent one of the plurality of receptacles between the support and the front plate;

coupling a string of lights with the fixture, the string of lights including a plurality of bulb groupings spaced from one another along an electrical cord, wherein coupling the string of lights includes placing the electrical cord in the cavity and placing each bulb grouping through one of the plurality of rear apertures into a corresponding separate one of the plurality of receptacles, wherein each bulb grouping corresponds with a visually different one of the plurality of packaged strands of light;

installing the fixture with the string of lights in a retail display system in relatively close proximity to the visually different ones of the plurality of packaged light strands corresponding with the bulb groupings of the string of lights.

18. A display fixture configured to receive a light strand, the display fixture comprising:

an elongated support defining a cavity, which is configured to accommodate at least a portion of the light strand, and including two generally parallel side walls collectively defining a plurality of pairs of cutouts, each cutout extending through an entire thickness of a corresponding one of the two generally planar side walls; and a plurality of cups formed separately from and coupled to the support such that each of the pairs of cutouts receives one of the plurality of cups, each of the cups defining a front aperture and a rear aperture opposite the front aperture;

wherein the cavity is accessible through the rear aperture of each of the plurality of cups to accommodate passage of least a portion of the light strand from the cavity through one of the plurality of rear apertures into one of the plurality of cups, each of the two generally parallel side walls defines a front edge, and the display fixture further comprises a front plate, the front plate is coupled to and extends between the front edges of the two generally parallel side walls and extends in front of an adjacent one of the plurality of cups to interpose the adjacent one of the plurality of cups between the support and the front plate in a manner securing the adjacent one of the plurality of cups between the support and the front plate.

* * * * *